US005566421A

United States Patent [19]

Pittman

[11] Patent Number: 5,566,421

[45] Date of Patent: Oct. 22, 1996

[54] VACUUM COMPENSATION VALVE

[76] Inventor: James Pittman, 269 King Street West, Dundas, Ontario, Canada, L9H 1W2

[21] Appl. No.: 530,101

[22] PCT Filed: Mar. 25, 1994

[86] PCT No.: PCT/CA94/00157

§ 371 Date: Sep. 26, 1995

§ 102(e) Date: Sep. 26, 1995

[87] PCT Pub. No.: WO94/22355

PCT Pub. Date: Oct. 13, 1994

[30] Foreign Application Priority Data

Mar. 26, 1993 [GB] United Kingdom ..... 9306331

[51] Int. Cl.[6] ..... A47L 9/00

[52] U.S. Cl. ..... 15/314; 15/319

[58] Field of Search ..... 15/314, 319, 301

[56] References Cited

U.S. PATENT DOCUMENTS 3,343,197 9/1967 Carsey ..... 15/314 X 3,443,274 5/1969 Rankin ..... 15/314

4,941,230 7/1990 Lamore ..... 15/314

4,977,638 12/1990 Best ..... 15/301

4,991,253 2/1991 Rechsteiner ..... 15/319 X

FOREIGN PATENT DOCUMENTS 889928 1/1972 Canada .

*Primary Examiner*—Chris K. Moore

*Attorney, Agent, or Firm*—R. Craig Armstrong

[57] ABSTRACT

Apparatus for vacuum collection of material, where a vacuum source is used for creating a vacuum to draw air into a displacement chamber, and at least two hoses are connected to the displacement chamber for vacuum collection of materials from various locations. Pressure sensors are connected to sense pressure in each hose, dampers are operable in response to the relative pressures between the hoses so as to vary the effective area of the respective connections between the hoses and the displacement chamber in order to equalize and optimize the relative pressures, and an automatic control such as a programmable logic controller is employed to operate the dampers in response to said sensed pressures.

3 Claims, 2 Drawing Sheets

VACUUM COMPENSATION VALVE

TECHNICAL FIELD

This invention relates to apparatus for vacuum or suction collection of material from a work site.

In vacuuming up material from a work site, particularly on large-scale jobs where large volumes of material may be involved, for example using equipment such as that shown in U.S. Pat. No. 5,064,454 by the present inventor, it is highly desirable to be able to use multiple collection hoses, so that material may be collected simultaneously by a number of workers from a variety of locations.

However, in using multiple hoses connected to the same vacuum source, the airstream will naturally take the path of least resistance. Therefore, if there is much debris to be collected at one location but very little at another location, most of the air will be drawn in at the location with little or no debris, drastically reducing the efficiency of collection where it is most needed.

Hitherto, there has been no satisfactory solution to this problem, to the best of the inventor's knowledge.

There is thus a need for apparatus in which multiple hoses can be run from a single vacuum source, without loss of efficiency. The need is particularly evident in applications where large volumes of solid materials are involved.

DISCLOSURE OF INVENTION

In view of the above need, it is the primary object of the invention to provide improved apparatus for the removal and collection of materials from a work site via vacuum collection, using multiple hoses connected to the same vacuum source.

The preferred embodiment of the invention provides apparatus for the removal and collection of material via a blower for creating a vacuum in a collection chamber or "displacement chamber". Multiple hoses are connected to the displacement chamber for collection of materials from various locations (whether immediately adjacent each other, where the hoses may be ganged together if desirable, or whether at various locations remote from each other).

To achieve the primary object of the invention, pressure sensors associated with each hose sense the pressure in the hose. Dampers are employed, in response to the relative pressures between the hoses, to vary the effective area of the connection between the hose and the displacement chamber, so as to equalize and optimize the relative pressures.

Although any suitable dampers may be employed, the preferred embodiment employs conical plungers or stoppers which are movable towards and away from corresponding seats by linear actuators.

Preferably, the dampers are controlled by a programmable logic controller (PLC) which receives signals from the pressure sensors and is programmed to move the dampers to their optimum positions for the sensed pressures.

Further features of the invention will be described or will become apparent in the course of the following detailed description.

BRIEF DESCRIPTION OF THE DRAWINGS

In order that the invention may be more clearly understood, preferred and alternative embodiments thereof will now be described in detail by way of example, with reference to the accompanying drawings, in which.

BEST MODE FOR CARRYING OUT THE INVENTION

Figure 1:
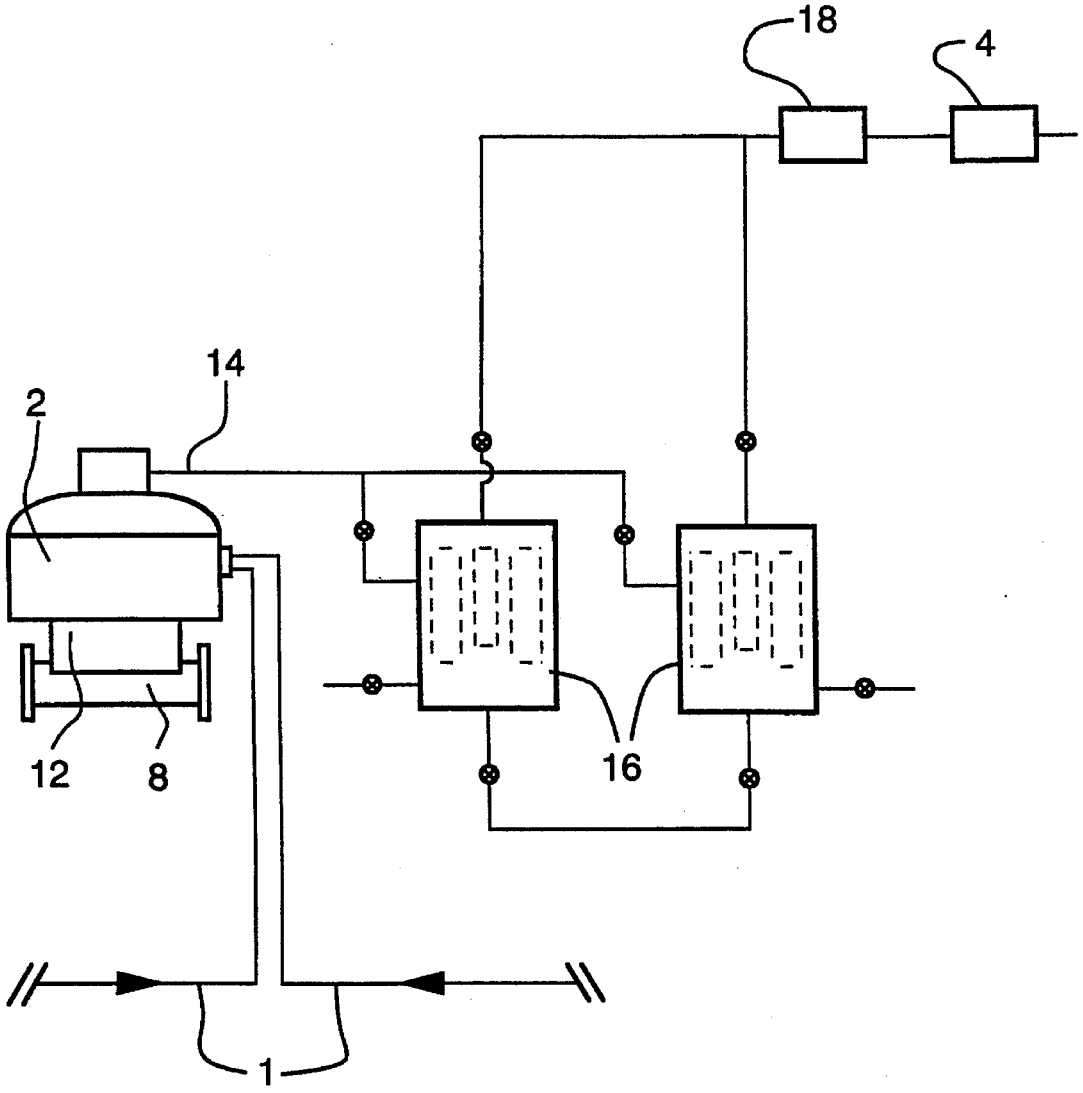
FIG. 1 is a schematic illustration of a typical collection system.
Figure 2:
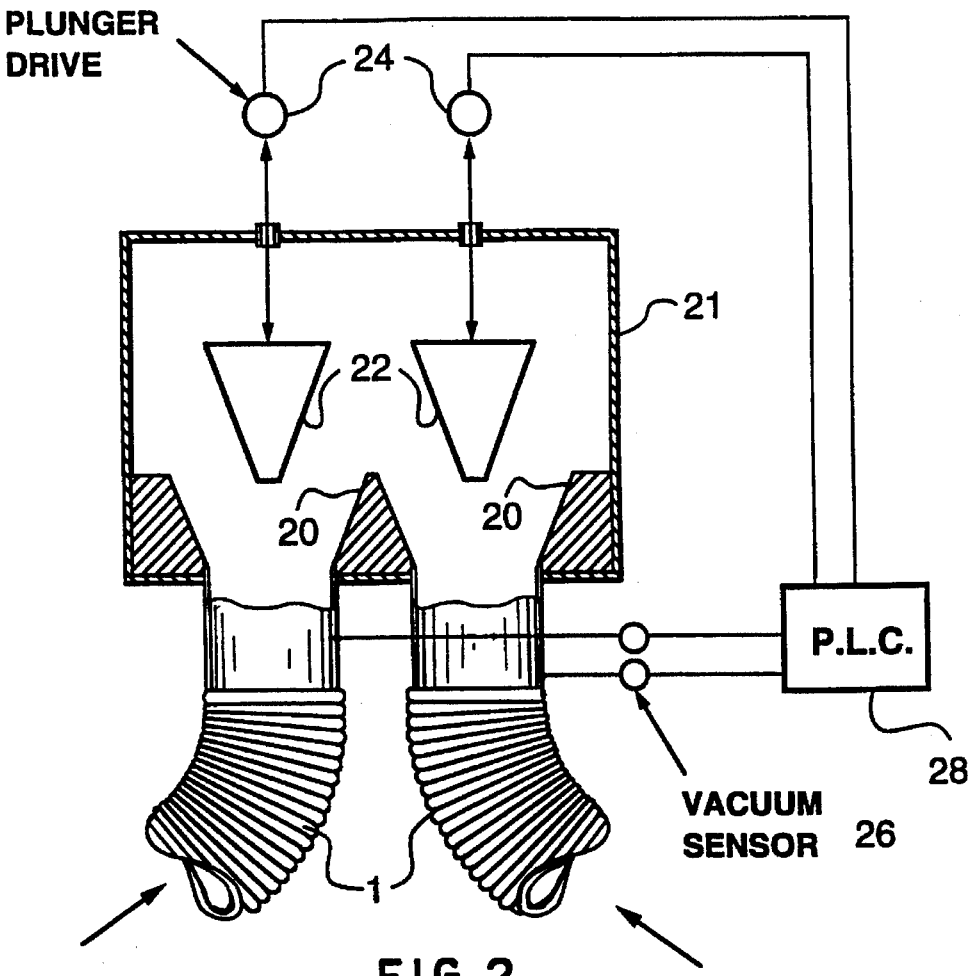
FIG. 2 is a plan view illustrating the principle of the invention.
Figure 3:
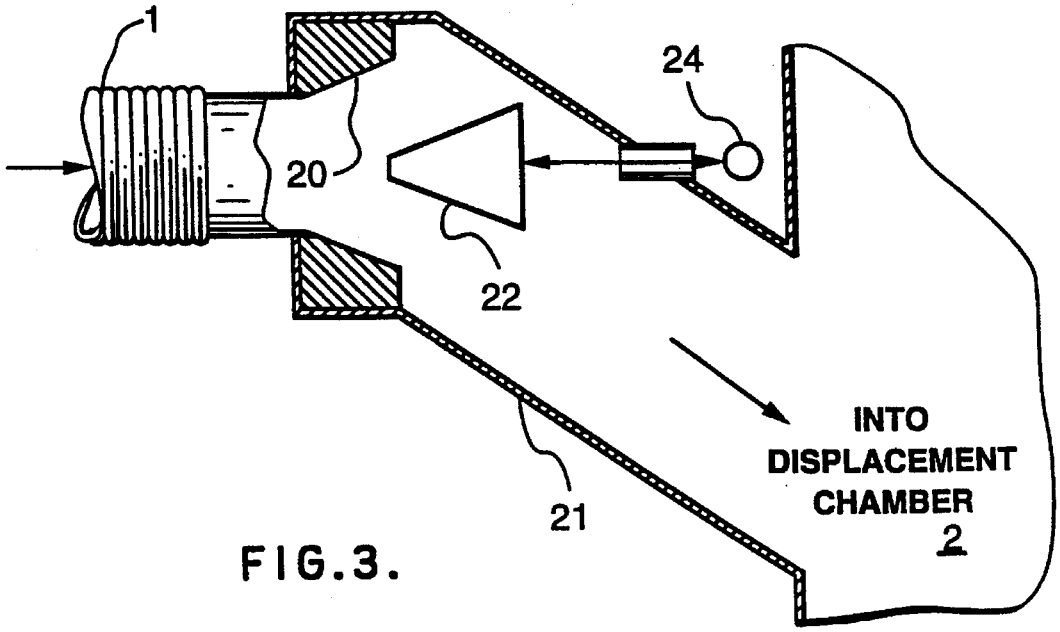
FIG. 3 is an elevation view corresponding to FIG. 2.

FIG. 1 is a schematic illustration of a typical collection system. The system is operated at negative pressure, i.e. under suction, by virtue of a large blower 4, which acts to draw air, through the system. The material to be collected is aspirated through a plurality of hoses from one or more removal locations. The inlet hoses are of indeterminate length, with any suitable number of sections coupled together to make up the hose lengths required to suit the particular job site(s). The hoses lead into a primary collection chamber or "displacement chamber" 2.

On entering the displacement chamber, most of the material falls through an outlet opening in the bottom, into a cylindrical discharge tunnel 8 via a transition housing 12.

The air leaves the displacement chamber 2 from the top via a displacement chamber exhaust 14. Although much of the material is removed in the displacement chamber, this air may still have a high material content. The entrained material is! filtered from the air, by parallel filter units 16, which are followed by a backup HEPA filter unit 18. These components are not relevant to the present invention, and are described strictly by way of background.

Where the hoses enter the displacement chamber 2, seats 20 are provided in a manifold 21, which may be conveniently located immediately adjacent the displacement chamber, although the precise location is obviously not critical. Plungers 22 are moveable towards and away from the seats by linear actuators 24 (illustrated schematically only), to vary the size of the openings into the displacement chamber, so as to control the airflow through the openings.

Each hose has a vacuum sensor 26 connected to sense the pressure, and the signals from the sensors are fed to a programmable logic controller (PLC) 28. The PLC is programmed to move the dampers to their optimum positions for the sensed pressures, to balance the airflow through the hoses, for optimum system performance.

For example, if a particular hose is not being called upon to collect any material, or less material than another hose, much more air will be drawn through that hose than is desirable. This will be reflected in the pressure sensed by the sensor 26 for that hose. In response to that pressure, the PLC will send a signal to the appropriate linear actuator 24 to move a plunger 22 to close down the opening to that hose to a point where the pressures are equalized.

Although the preferred embodiment employs conical plungers or stoppers which are movable towards and away from corresponding seats, as described above, it should be appreciated that any suitable means could be employed to close down the opening size, such as an iris valve, a sliding plate, or any other desirable means.

It should also be clearly understood that although only two hoses are illustrated, the principle of the invention may be readily applied to a system with any number of hoses.

It will be appreciated that the above description relates to the preferred embodiment by way of example only. Many variations on the invention will be obvious to those knowledgeable in the field, and such obvious variations are the scope of the invention as described and claimed, whether or not expressly described.

INDUSTRIAL APPLICATION

The invention is applicable in any situation where it is desired to collect matter using more than one outlet from a single vacuum source.

I claim:

1. Apparatus for vacuum collection of material, comprising a vacuum source for creating a vacuum to draw air into a displacement chamber (2), and at least two hoses (1) connected to said displacement chamber for vacuum collection of materials from various locations, characterized by pressure sensors (26) connected to sense the pressure in each said hose, dampers (22) operable in response to the relative pressures between the hoses so as to vary the effective area of the respective connections between the hoses and the displacement chamber in order to equalize and optimize the relative pressures, and automatic control means (28) to so operate said dampers in response to said sensed pressures.

2. Apparatus as recited in claim 1, where said dampers are conical plungers (22) which are movable towards and away from corresponding seats (20) by linear actuators (24).

3. Apparatus as recited in claim 1, where said automatic control means include a programmable logic controller (28) which receives signals from said pressure sensors (26) and is programmed to move said dampers (22) to their optimum positions for the sensed pressures.

* * * * *